US006675710B2

(12) United States Patent
Friedman et al.

(10) Patent No.: US 6,675,710 B2
(45) Date of Patent: Jan. 13, 2004

(54) METHOD OF PREPARATION OF ELECTROSTATICALLY IMAGED PRINTING PLATES

(75) Inventors: Patrick Friedman, Bridgewater, NJ (US); Dominique LaPotre, Foulayronnes (FR)

(73) Assignee: Kodak Polychrome Graphics LLC, Norwalk, CT (US)

( * ) Notice: Subject to any disclaimer, the term of this patent is extended or adjusted under 35 U.S.C. 154(b) by 54 days.

(21) Appl. No.: 10/034,676

(22) Filed: Dec. 21, 2001

(65) Prior Publication Data

US 2003/0143474 A1 Jul. 31, 2003

(51) Int. Cl.[7] ..... G03G 13/28
(52) U.S. Cl. ..... 101/463.1; 101/470; 430/49
(58) Field of Search ..... 101/463.1, 470; 430/18, 49, 97

(56) References Cited

U.S. PATENT DOCUMENTS

| | | | | |
|---|---|---|---|---|
| 3,315,600 A | | 4/1967 | Tomanek | 101/149.2 |
| 4,271,249 A | | 6/1981 | Gilliams et al. | 430/101 |
| 4,444,858 A | | 4/1984 | Nishibu et al. | 430/49 |
| 4,457,992 A | | 7/1984 | Bhattacharjee et al. | 430/49 |
| 4,500,618 A | | 2/1985 | Shiba et al. | |
| 5,141,838 A | | 8/1992 | Aoshima et al. | 430/191 |
| 5,882,828 A | * | 3/1999 | Kato et al. | 430/49 |
| 6,014,929 A | | 1/2000 | Teng | 101/456 |
| 6,025,100 A | | 2/2000 | Verschueren et al. | 430/49 |
| 6,083,588 A | | 7/2000 | Kagawa et al. | |
| 6,105,500 A | | 8/2000 | Bhambra et al. | 101/455 |
| 6,376,140 B1 | * | 4/2002 | Friedman et al. | 430/49 |

FOREIGN PATENT DOCUMENTS

| | | |
|---|---|---|
| DE | 1208307 | 1/1966 |
| DE | 19513584 | 10/1995 |
| EP | 0840179 | 5/1998 |
| EP | 0898205 | 2/1999 |
| EP | 0901045 | 3/1999 |

OTHER PUBLICATIONS

Pending U.S. patent application No. 09/706,521, filed Nov. 3, 2000.

* cited by examiner

*Primary Examiner*—John Goodrow
(74) *Attorney, Agent, or Firm*—Faegre & Benson, LLP

(57) ABSTRACT

A method of preparing an imaged element useful in lithographic printing comprises:

(a) electrostatically imaging at least one surface of a substrate with a toner composition;

(b) heating the imaged substrate a first time using non-contact heating to a first substrate temperature $T_P$; and (c) heating the imaged substrate a second time to a substrate temperature $T_F$, wherein the method does not comprise a development step between steps (b) and (c). This method is used to obtain an imaged element with adequate fuser toning while avoiding substrate buckling and distortion.

25 Claims, 1 Drawing Sheet

METHOD OF PREPARATION OF ELECTROSTATICALLY IMAGED PRINTING PLATES

BACKGROUND OF THE INVENTION

1. Field of the Invention

This invention relates to a method of preparing an electrostatically imaged printing plate, and to a method of printing using a plate prepared by such a method. More particularly, the method of this invention comprises imaging a substrate electrostatically with a toner composition, then heating the imaged substrate via non-contact (e.g. radiant heating) a first time to "pre-heat" the substrate to minimize distortion of substrate flatness during toner fusing and to reduce the temperature requirements of the second fusing. The imaged and pre-heated substrate is thereafter heated a second time using radiant or contact heating to fix the toner on the substrate.

2. Background Information

The manufacture of printing plates, including printing plates used in lithographic printing processes, using electrostatic imaging techniques is well known in the art. In such methods, the fixed toner images are the olephilic ink receptive portions of the plate, and upon contact of the plate with an appropriate ink or ink-containing solution, the desired ink image may be transferred, or "offset," from the plate to an appropriate medium, such as a rubber blanket, which is then used to print onto a medium such as paper. Examples of methods of preparing printing plates which are electrostatically imaged include:

U.S. Pat. No. 3,315,600, which discloses a method for preparing a printing plate in which a support having a hydrophilic surface is provided with a covering layer, the covering layer is electrostatically imaged using a toner composition, the image is fused or fixed via heating, and the covering layer is removed from the non-imaged areas by means of an aqueous solvent. However, unlike the invention described herein, only a single heating step is employed to fix the toner image to the coated support.

U.S. Pat. No. 4,444,858, which discloses a method of preparing a lithographic printing plate in which a metal substrate is coated with a synthetic resin layer, and a toner image formed on a photosensitive sheet by an electrophotographic process is transferred and fixed to the synthetic resin layer. A solvent is used to remove the non-imaged areas of the resin layer, which are not covered by the fixed toner image. Furthermore, the toner may be removed or used as a mask. However, unlike the present invention, no second heating or fusing step is disclosed.

U.S. Pat. No. 4,457,992, which discloses an etchable electrophotographic printing plate comprising an electroconductive support coated with a light-sensitive photoconductive zinc oxide and a sensitizing dye dispersed in an organic resin binder. Such plates are typically referred to as "organic photoconductor" or "OPC" plates. The coating is applied to the substrate and dried to remove substantially all of the solvent. The resulting plate may be imaged with electrostatic toner, and the non-imaged portions of the coating are removed via a basic aqueous solution. The plate may thereafter optionally be heated to enhance plate endurance. However, unlike the invention described herein, the coating requires light-sensitive photoconductive zinc oxide to be used. In contrast, in the present invention, no light-sensitive photoconductive coating is applied to the hydrophilic surface.

U.S. Pat. No. 4,500,618 discloses an electrophotographic plate having a conductive layer thereon, which is electrically charged and imagewise exposed, followed by application of a liquid toner in a solvent. The solvent is substantially removed by heating and the material is heated a second time to fix the toner image. However, unlike the invention described herein, the coating requires light-sensitive photoconductive zinc oxide to be used. In contrast, in the present invention, no light-sensitive photoconductive coating is applied to the hydrophilic surface.

U.S. Pat. No. 6,025,100, which discloses a printing plate prepared by transferring a toner image to an image receiving element which is a support having an image receiving layer thereon. The layer contains a hydrophilic binder, $TiO_2$ particles, and a matting agent, and the layer is cross-linked with hydrolyzed tetramethyl silicate or hydrolyzed tetraethylsilicate. However, unlike the invention described herein, there is no disclosure of a second heating or fusing of the toner to the imaged receiving element to fix the toner on the substrate.

U.S. patent application Ser. No. 09/706,521 discloses a printing plate prepared by applying an alkali soluble coating composition comprising at least one polymer composition to a hydrophilic surface on a substrate to provide the surface with at least one alkali soluble layer. The coated substrate is electrostatically imaged using a toner composition which is applied to the alkali soluble layer. The imaged substrate is heated a first time to fuse the toner composition to the alkali soluble layer, thereby protecting the underlying alkali soluble layer from subsequent contacting with developer solution in the imaged areas. The imaged plate is thereafter contacted with an aqueous alkali solution to remove undesired toner composition and the non-imaged portion of the alkali soluble layer which is unprotected by the fused toner composition, and the imaged plate is thereafter heated a second time to fix the remaining toner and underlying alkali soluble layer to the substrate. Unlike the invention described herein, a development step is required between the two thermal treatments.

Lithographic printing plates having an imageable layer overlaid upon an intermediate layer applied to a substrate are also known. For example, U.S. Pat. No. 6,014,929 discloses a lithographic plate having a rough substrate, a releasable interlayer applied to the rough substrate surface, and a radiation-sensitive layer applied to the interlayer. However, unlike the invention described herein, there is no disclosure of the use of two separate heating or fusing steps with electrostatic imaging.

However, several problems are known to be associated with the preparation of electrostatically imaged printing plates. For example, toner applied to a metal substrate often insufficiently fuses if only a standard contact fusing step is employed. This is because the metal substrate acts as a heat sink and diverts heat from the contact fuser roller, thereby resulting in insufficient energy to melt and fuse the toner. Although this problem may be avoided by using only radiant non-contact fusing, the energy required to fuse the toner using only radiant heating at the speeds typically employed in electrostatic imaging cause the metal substrate to buckle and distort due to the rapid differential expansion of the metal.

In view of the foregoing, it would be advantageous to employ electrostatic imaging of a printing plate in such a manner as to achieve adequate toner fusing and minimize or eliminate undesired buckling and distortion of the metal substrate. It is one object of this invention to provide a method of preparing an electrostatically imaged element in which adequate toner fusing is achieved and substrate buckling and distortion is avoided. It is another object of this invention to provide such an imaged element. It is yet another object of this invention to provide a method of printing using such an imaged element. The imaged element of this invention advantageously avoids rapid differential expansion of the metal substrate by controlling the rate of substrate heating. The imaged element of this invention also advantageously may be employed in high speed fusing applications which employ thick materials which require high levels of energy input. In addition, in one embodiment of this invention the first non-contact "preheating" of the substrate coupled with the second heating of the substrate using contact heating enables the contact heater rolls to squeeze the toner into the substrate surface, thereby improving toner adhesion.

SUMMARY OF THE INVENTION

A method of preparing an imaged element comprises:

(a) electrostatically imaging at least one surface of a substrate with a tone composition;

(b) heating the imaged substrate a first time using non-contact heating to a substrate preheat temperature $T_p$; and (c) thereafter heating the imaged substrate a second time to substrate temperature $T_F$, wherein the method does not comprise a development step between steps (b) and (c).

DETAILED DESCRIPTION OF THE INVENTION

This invention is directed to imageable media, including lithographic printing plates and the preparation and use thereof. Conventional printing plate substrates such as aluminum may be used as the printing plate substrate in all aspects of this invention.

The method of the invention does not include a development step between the first heating step and the second heating step. The term "development step" as used herein refers to contacting the imaged and non-imaged portions of the coating of the printing plate substrate with a developing solution, such as an alkaline solution or an organic solvent.

In various preferred embodiments, the printing plate substrate used in this invention may be subjected to treatments such as electrograining, anodization, and silication to enhance its surface characteristics. The surface characteristics that are modified by such treatments are roughness, topology, and the nature and quantity of surface chemical sites.

Exemplary aluminum substrates that can be employed in all aspects of this invention are given in Table 1. Substrates chosen for use in this invention are preferably based on aluminum oxide, and may be subjected to various conventional surface treatments as are well known to those skilled in the art. These treatments also result in different surface roughness, topology, and surface chemical sites, as summarized in Table 1.

TABLE 1

Exemplary Aluminum Substrates for Printing Plate

| Substrate name | Surface Treatment | Interlayer Treatment | Surface Property |
|---|---|---|---|
| AA | Quartz Grained and Anodized | None | Acidic |
| EG-PVPA | Electrograined and Anodized | Polyvinyl phosphoric acid | Acidic |
| PF | Electrograined and Anodized | Sodium dihydrogen phosphate/Sodium fluoride | Acidic |
| G20 | Electrograined and Anodized | Vinylphosphonic acid/acrylamide copolymer | Acidic/ Amphoteric |
| CHB-PVPA | Chemically grained Basic etched | Polyvinyl phosphoric acid | Acidic |
| PG-PVPA | Pumice-grained | Polyvinyl phosphoric acid | Acidic |
| EG-Sil | Electrograined and Anodized | Sodium Silicate | Basic |
| DS-Sil | Chemically Grained and Anodized | Sodium Silicate | Basic |
| PG-Sil | Pumice Grained and Anodized | Sodium Silicate | Basic |
| CHB-Sil | Chemically Grained, Anodized and Silicated | Sodium Silicate | Basic |

In a preferred embodiment, the substrate is an aluminum substrate. In another preferred embodiment, the substrate is coated with a polymer coating composition. The polymer composition may be solvent or aqueous soluble. The total coating weight is in the range of 0.02–5.0 g/m$^2$, more preferably 0.2–1.0 g/m$^2$.

In another preferred embodiment, the method further comprises a development step following step (c).

In another preferred embodiment, the method does not comprise a development step following step (c).

Figure 1:
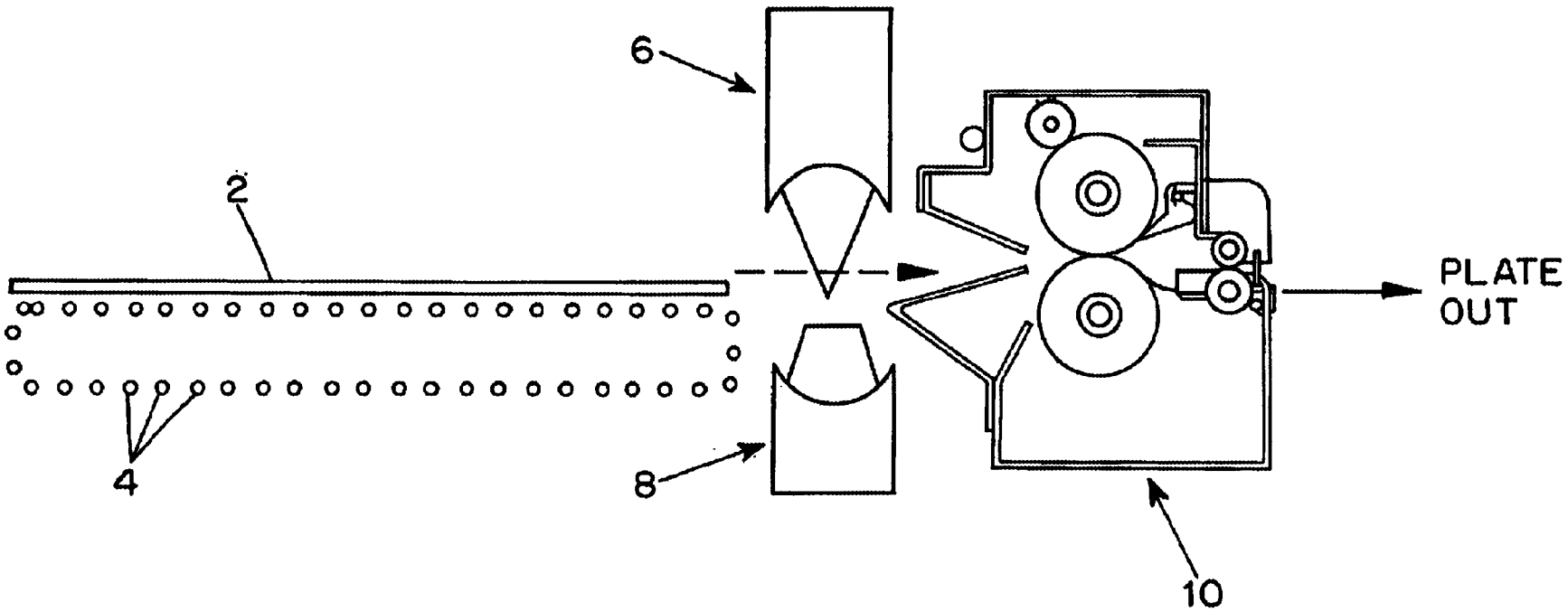
FIG. 1 schematically depicts the overall process configuration for the preparation of an imaged element in accordance with this invention.

"AA" means "quartz grained and anodized with no interlayer." The aluminum surface is first quartz grained and then anodized using DC current of about 8 A/cm$^2$ for 30 seconds in a $H_2SO_4$ solution (280 g/liter) at 30° C.

"EG" means "electrolytic graining." The aluminum surface is first degreased, etched and subjected to a desmut step (removal of reaction products of aluminum and the etchant). The plate is then electrolytically grained using an AC current of 30–60 A/cm$^2$ in a hydrochloric acid solution (10 g/liter) for 30 seconds at 25° C., followed by a post-etching alkaline wash and a desmut step. The grained plate is then anodized using DC current of about 8 A/cm$^2$ for 30 seconds in a $H_2SO_4$ solution (280 g/liter) at 30° C.

"PVPA" is a polyvinylphosphonic acid. The plate is immersed in a PVPA solution and then washed with deionized water and dried at room temperature.

"DS" means "double sided smooth." The aluminum oxide plate is first degreased, etched or chemically grained, and subjected to a desmut step. The smooth plate is then anodized.

"Sil" means the anodized plate is immersed in a sodium silicate solution (80 g/liter), commercially available under the trademark N-38 from the Philadelphia Quartz Co. at 75° C. for one minute. The coated plate is then rinsed with deionized water and dried at room temperature.

"PG" means "pumice grained." The aluminum surface is first degreased, etched and subjected to a desmut step. The plate is then mechanically grained by subjecting it to a 30% pumice slurry at 30° C., followed by a post-etching step and a desmut step. The grained plate is then anodized using DC current of about 8 A/cm$^2$ for 30 seconds in an $H_2SO_4$ solution (280 g/liter) at 30° C. The anodized plate is then coated with an interlayer.

"G20" is a printing plate substrate which is described in U.S. Pat. No. 5,368,974, the disclosure of which is incorporated herein by reference in its entirety.

"CHB" means chemical graining in a basic solution. After an aluminum substrate is subjected to a matte finishing process, a solution of 50 to 100 g/liter NaOH is used during graining at 50 to 70° C. for 1 minute. The grained plate is then anodized using DC current of about 8 A/cm$^2$ for 30 seconds in an $H_2SO_4$ solution (280 g/liter) at 30° C. The anodized plate is then coated with a silicated interlayer.

"PF" substrate has a phosphate fluoride interlayer. The process solution contains sodium dihydrogen phosphate and sodium fluoride. The anodized substrate is treated in the solution at 70° C. for a dwell time of 60 seconds, followed by a water rinse, and drying. The deposited dihydrogen phosphate is about 500 mg/m$^2$.

A "basic" surface will have a plurality of basic sites and acidic sites present, with the basic sites predominating to some degree. Similarly, an "acidic" surface will have a plurality of acidic sites and basic sites present, with the acidic sites predominating to some degree. It is known by one of ordinary skill in the art that the PG-Sil printing plate substrate appears to have a higher silicate site density than the DS-Sil printing plate substrate, and is more basic.

In one preferred embodiment of this invention, the substrate itself must have at least one hydrophilic surface. If the substrate used does not initially have at least one hydrophilic surface, the surface of the substrate may be treated to render it hydrophilic as set forth above with respect to various preferred embodiments. This may be accomplished by methods well known to those skilled in the art. For example, in one preferred embodiment the substrate employed is hydrophilized with PVPA. In another preferred embodiment, the substrate is hydrophilized with silicate. Such hydrophilization of the substrate surface may be accomplished via other techniques well known in the art. In yet another preferred embodiment, a surface of the substrate is first coated with a hydrophilic layer by contacting the substrate surface with a liquid comprising a silicate solution in which particulate material is dispersed, as disclosed, for example, in U.S. Pat. No. 6,105,500, which is incorporated herein by reference in its entirety. As disclosed in U.S. Pat. No. 6,105,500, the silicate solution may comprise one or more, but preferably only one, metal or non-metal silicate. Such metal silicates may be alkali metal silicates, and such non-metal silicates may be quaternary ammonium silicates. The particulate may be an organic or inorganic material. Organic particulate materials may be provided by latexes. Inorganic particulate materials may be selected from alumina, silica, silicon carbide, zinc sulphide, zirconia, barium sulphate, talcs, clays (e.g. kaolin), lithopone and titanium oxide.

The surface of the substrate may optionally be coated with a coating layer comprising at least one polymer composition component to provide the substrate surface with at least one coating layer. The coating layer may preferably be alkali soluble. Polymer layers which may be used in this invention include, without limitation, acrylic compositions (including acrylic resins, copolymers and terpolymers), phenolic compositions, urethane-urea compositions (including polyurethanes), phenolic-acrylic compositions, gelatin and variations and mixtures thereof. Such polymer compositions preferably have an average molecular weight in the range of about 8000–50,000, more preferably from about 10,000–30,000, most preferably from about 15,000–25,000. The acrylic terpolymers, if employed, preferably have an acid number (AN) in the range of about 10–200, preferably 50–125, most preferably about 90–95.

In one particularly preferred embodiment, poly (4-vinylphenol) is employed as a polymer composition component of the coating composition. In another particularly preferred embodiment, an acrylic terpolymer (Polymer I) having an AN of about 90 which is chain polymerized from ethyl acrylate (EA), methyl methacrylate (MMA) and methyl acrylic acid (MAA) is employed as a polymer composition component of the coating composition. In a preferred embodiment, Polymer I has a EA:MMA:MAA mole % ratio of 9.8:74.9:15.3.

In another particularly preferred embodiment a polyurethane resin (Polymer II) is employed as a polymer composition component of the coating composition. Polymer II is preferably a polyurethane resin based on acrylonitrile (ACN)/methyl methacrylate (MMA)/amino sulfonylphenylmethacrylamide (ASPM), such as disclosed in U.S. Pat. No. 5,141,838, which is incorporated herein by reference in its entirety. U.S. Pat. No. 5,141,838 specifically discloses a Polymer II-type polyurethane resin having a ACN:MMA:ASPM mole % ratio of 32:41:27 (see Table 1, compound (d) therein), which may be used as the polyurethane resin component herein. The polyurethane component may be synthesized, for example, as described in U.S. Pat. No. 5,141,838 "Synthesis Example 2" at col. 18, line 58-col. 20, line 4, except that MMA is substituted for EA therein. In a particularly preferred embodiment, Polymer II is a polyurethane resin having a ACN:MMA:ASPM mole % ratio of 24:42:34.

In another particularly preferred embodiment, the combination of a polyurethane resin such as Polymer II and an acrylic terpolymer is employed as a polymer composition component of the coating composition. In a preferred embodiment, the acrylic terpolymer is a terpolymer (Polymer III) of methyl acrylic acid (MAA), n-phenylmaleimide (NPM) and methacrylamide (MAAM) having an AN of about 95. In a particularly preferred embodiment, Polymer III has a MAA:NPM:MAAM mole % ratio of 25:40:35. The synthesis and/or structures of these compounds are set forth below:

Polymer I:

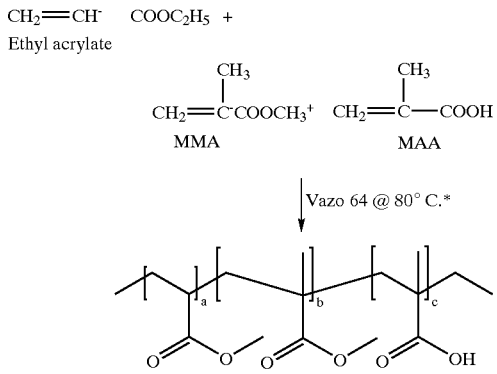

where a = 5–20, b = 50–85, c = 5–25

Polymer II:

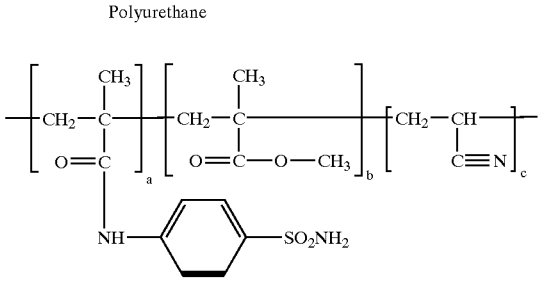

where a = 15–35, b = 25–70, c = 25–50

Polymer III:

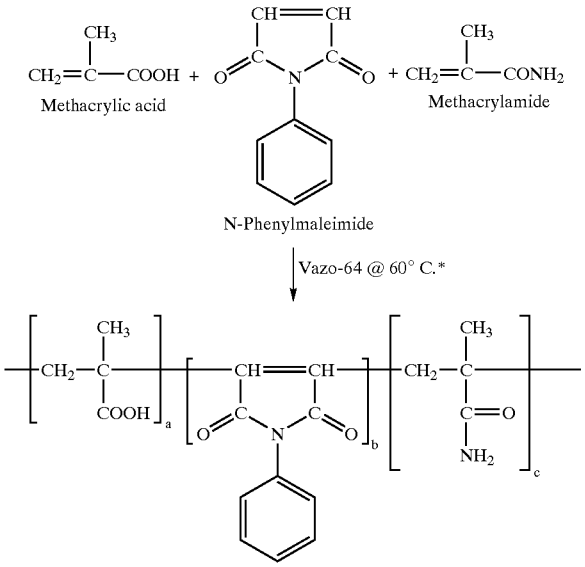

where a = 5–35, b = 30–50, c = 25–45

(Vazo 64 is 2-2,-azo bis(2-methylpropane nitrile), available from E.I. DuPont de Nemours & Co.)

In another particularly preferred embodiment, polyethylene glycol (PEG) is employed as a polymer component of the water or fountain soluble coating. The PEG used has a molecular weight in the range of 1000–10,000, preferably 2500–6500, most preferably 4000–5000.

Hydrophilic coating compositions, suitable for functioning as non-image areas, may additionally comprise at least one cross-linking moiety or polymerizable composition, as will be well understood by those skilled in the art. Cross-linkers particularly preferred for use in the coating composition include titanium complexes such as TYZOR AA-75 (a titanate available from DuPont). Other cross-linkers suitable for use include hydrolysed tetramethyl orthosilicate, hydrolysed tetraethyl orthosilicate, formaldehyde, melamine formaldehyde resins, urea formaldehyde resins, and zirconate compounds.

The coating composition may additionally comprise at least one contrast dye. Suitable dyes which optionally may be used in the coating composition are those which are easy to dissolve in the solvent or solvent mixture used in the coating or which can be introduced as pigment in dispersed form. Suitable contrast dyes are, for example, rhodamine dyes, methyl violet, anthraquinone pigments and phthalocyanine dyes or pigments, the series of triarylmethane dyes (such as Victoria Blue BO, Victoria Blue R, crystal violet) or diazo dyes (such as 4-phenylazodiphenylamine, azobenzene or 4-N,N-dimethylaminoazobenzene). Preferably, the dyes are present in the coating composition in an amount of 0.01 to 10 weight %, with about 0.1 to 5 weight % being particularly preferred.

Any suitable solvent for application of the polymer composition known to those skilled in the art may be used in preparing the coating composition. Particularly preferred solvents for use are water, 2-methoxyethanol and methyl cellusolve. Other solvents suitable for use include ethanol, methyl ethyl ketone, toluene, DOWANOL (a product of the Dow Chemical Co.), and water. The choice of solvent is dependent upon the particular components of the coating composition, as will be well understood by those skilled in the art.

After the coating solution is prepared, it may be applied to the substrate surface via methods well known to those skilled in the art, such as in-line hopper coating, bar coating, curtain coating, extrusion coating, pan coating, whirl coating, brushing and the like, and dried at temperatures in the range of 40–60° C. The coating, once applied, provides the substrate with at least one layer which is alkali, water, or solvent soluble at a pH in the range of about 6.0 to about 14.0. The coating weight, once applied to the substrate, should be in the range of 0.02–5.0 g/m$^2$, more preferably 0.2–1.0 g/m$^2$.

The uncoated or coated substrate face is imaged electrostatically using a toner composition. As discussed above, electrostatic imaging techniques are well known to those skilled in the art, as exemplified by U.S. Pat. Nos. 3,315,600; 4,444,858; and 6,025,100, the disclosures of which are all incorporated herein by reference. For example, the toner composition image may be received by the substrate or coated substrate using direct transfer from an OPC drum or belt, or using indirect transfer from a belt or drum that transfers the image from the OPC drum or belt to the substrate. It will be understood by those skilled in the art that the purpose of this electrostatic imaging is to transfer the desired image and information contained therein from the information source (e.g. a computer or the like) to the uncoated or coated substrate by digital or analog means for inclusion in the printing plate of this invention.

Conventional toner compositions, as are well known in the art, may be used to image the coated or uncoated substrate face. Toner compositions suitable for use in photocopiers, laser printers and the like are suitable for use as the toner composition in the present invention and are preferred. Further information about toner compositions may be found, for example, in U.S. Pat. No. 4,271,249, EP 901045 and EP 898205, all of which are incorporated herein by reference in their entirety. In one embodiment of this invention, the toner composition used is photocopier toner comprising carbon black surrounded by a layer of styrene-acrylic or styrene-butadiene resin, and the toner composition has a Tg in the range of 70–90° C. In another preferred embodiment of this invention, cyan toner compositions comprising a PET polymer and having Tg in the range of 75–85° C. are particularly preferred.

The method of this invention is further illustrated with reference to FIG. 1. In FIG. 1, a coated or uncoated substrate 2 has toner imagewise applied thereto. The imaged substrate is conveyed via a feed plate 4 to a first or "preheat" section which uses non-contact heating to heat the imaged plate to a substrate temperature $T_p$. The primary purpose of this initial heating is to warm the metal substrate prior to the second heating or "fusing" step, to permit the heat from the second heating step to be used to melt and fuse the toner, and to avoid substrate buckling or distortion. The initial heating is accomplished by as non-contact fusing, as is well known to those skilled in the art. In the embodiment depicted in FIG. 1, the preheat section comprises a top lamp 6 and bottom lamp 8, as shown, which provide radiant heating.

The resulting imaged and pre-heated substrate is thereafter heated in a second heating or "fusing" step to a substrate temperature $T_F$ which is greater than $T_p$. Preferably $T_F$ is also equal to or greater than the glass transition temperature Tg of the toner composition. The primary purpose of this second heating step is to fix the image created by the toner to the substrate or polymer coating residing on the substrate. This second heating may be accomplished by techniques such as contact, solvent or non-contact fusing, as are well known to those skilled in the art. In the embodiment depicted in FIG. 1, the second heating step is accomplished using a contact fuser 10, as will be well understood by those skilled in the art. After this second heating, the imaged plate may be gummed, if desired, and used on press for lithographic printing and the like. This procedure does not employ a distinct development step between imaging and printing. Rather, development takes place "on-press" in preferred embodiments. A preferred developer is the fount solution applied to the printing form at the commencement of printing. Accordingly in one embodiment of this invention there is provided a printing process carried out on a printing plate precursor which has been imaged, the printing process employing a fount solution which effects development by removing areas of the coating which have not been imaged. No chemical development step is required when the plate is used on press as a fountain developable composition. Thus, the imaged precursor may be placed on press and developed on-press, thereby obtaining one embodiment of the invention.

Without wishing to be bound by any one theory, it is believed that during the first heating step, the metal substrate is preheated and thereby avoids acting as a heat sink during the second heating step. The second heating step causes the toner to fuse, and the combination of first and second heating steps minimizes buckling or distortion of the metal substrate and allows for high speed fusing of bulky substrates.

Typically, actual printing is achieved by placing the imaged printing plate of this invention on a printing press, contacting the plate with an ink, thereby causing the ink to adhere to the oleophilic imaged portion of the plate, and thereafter transferring imagewise the ink from the printing plate to a receiving material such as a rubber blanket or the like, as is well known to those skilled in the art, for eventual transfer of the inked image to newspaper, books or other printed media.

The invention is exemplified by, but not limited to, the following examples. In these examples, the substrates were imaged using a QMS 330 electrostatic laser printer from which the fuser was disabled. The imaged substrates were subjected to first and second heating steps using a non-contact preheater having top and bottom heating lamps obtained from Philips (Type 64232022) 230 Volt 2000 Watt Base Reflector Coated Halogen InfraRed for the first step and a standard contact fuser available from Canon for the second step.

EXAMPLE 1

A sample of brush-grained and electrochemically-grained, phosphoric acid anodized and silicated 8-gauge aluminum plate was tested at a transport speed of 90 inches/min. The following results were obtained:

| Top Lamp Setting* | Bottom Lamp Setting* | Result |
|---|---|---|
| 0 | 0 | No fusing |
| 3 | 3 | Cold offset |
| 4 | 4 | Cold offset |
| 5 | 5 | Fused |
| 6 | 6 | Fused |
| 7 | 7 | Hot offset |
| 8 | 8 | Hot offset |
| 10 | 10 | Hot offset |

*Lamp settings are dial settings on a rheostat that varies the power to the lamps used in the preheat section.

From the above table, it was observed that if the pre-heat section was too hot (i.e., the dial setting was too high), a ghost image appeared (heat offset) on the plate. Also, if the pre-heat section was too cold (i.e., the dial setting was too low), the toner would not melt sufficiently and a ghost image (cold offset) also appeared on the plate. Offset is the unwanted accumulation of toner onto the hot contact fuser roller used in the second heating step. Generally this resulted in some of the image toner remaining on the hot contact roller as the substrate and non-fused toner image passed through. Upon the next revolution of the roller the toner was subsequently deposited onto the substrate in an area which did not correspond to the desired image pattern.

It was also observed that to contact fuse at the desired transport speed of 90 inches/min. the pre-heat section power input was required to be in a certain range. If the transport speed was increased or decreased the required power input from the pre-heat changed proportionally. This example also demonstrated that contact fusing alone, employing conventional electrostatic fuser rollers without preheat, was not viable.

EXAMPLE 2

A 6-gauge aluminum substrate (smooth DS plate) was imaged and heated as described in Example 1, except that one-half of the power used for the two lamps was used in the pre-heat section in this example. The temperature of the contact fuser used for the second heating step was monitored at 150° C. The toner image was successfully fused to the substrate.

EXAMPLE 3

A 12-gauge, brush grained, phosphoric acid anodized, silicated aluminum substrate was imaged and heated as described in Example 1, except that three-fourths of the power used for the two lamps was used in the pre-heat section in this example. The temperature of the contact fuser used for the second heating step was monitored at 150° C. The toner image was successfully fused to the substrate.

EXAMPLE 4

A brush-grained and electrochemically grained, phosphoric acid anodized and silicated aluminum substrate was coated with Polymer I. The plate was imaged as described in Example 1, and heated as described in Example 1. A transport speed of 112 inches/minute was used in this example. The temperature of the contact fuser used for the second heating step was monitored at 150° C. The toner image was successfully fused to the substrate.

EXAMPLE 5

An EG-PVPA aluminum substrate (available from Kodak Polychrome Graphics) was coated with gelatin. The plate was imaged as described in Example 1, and heated as described in Example 1, except that 0.6 of the power for the two lamps in the preheat section was used in this example. The temperature of the contact fuser used for the second heating step was monitored at 150° C. The toner image was successfully fused to the substrate.

EXAMPLE 6

On-press developable plates were coated as per table 2 below for comparison with un-coated EG-PVPA aluminum plate substrates employing conventional oven fusing and the fusing method of this invention.

TABLE 2

On-Press Developable Plate Formulations

| Plate Sample | Plate 1 | Plate 2 |
|---|---|---|
| Amount of solution | 100 ml | 200 ml |
| % solid in solution | 2.72 | 2.50 |
| Polyethylene glycol (MW = 4600) | 1.36 g | 2.5 g |
| LUDOX ® SM-30 (colloidal silica 30%) | 0.6 g | 1.2 g |
| Methyl Cellusolve | 97.82 g | 195.0 g |
| MONASTAT ® 1195 | 1.36 g | 2.5 g |
| Substrate type | EG-PVPA (polyvinylphosphonic acid) ® | |
| Whirl coat at 70 RPM | | |
| Drying condition 120° F. | | |

The imaging and toner application was performed in a QMS 330 electrostatic imager with the fusing unit removed so as not to destroy the image on the plate after imaging. The fusing methods employed were the control fusing process performed in a Hauptschalter rack oven at 130° C. at a throughput of 96 inches per minute and the Dual Fusing process of this invention also at a throughput of 96 inches per minute. After fusing the imaged plates were then visually inspected, evaluated and put directly on press. Likewise the resulting press sheets were evaluated and rated.

In comparing the imaged and fused on-press developable plates that received both the control oven fusing and the Dual Fusing of this invention we conclude that there is no difference between fusing with respect to visual appearance and the fine image detail is equal in quality with very clear, high contrast images. The solid areas appeared full and the 42 $\mu$m lines were clearly visible for both fusing methods. The same high quality image was obtained for all samples from the press test for more than 20,000 impressions. The results of this comparison show that the fusing method of this invention can deliver equivalent quality to oven fusing without the need for a large oven, a long transverse path or manual handling.

The imaging and press test results for the un-coated plates showed similar results to the on press developable plates.

Although the plate images were grainy with low contrast and the solid areas contained voids and the 42 $\mu$m lines were broken. The results of this second series shows that the fusing method of this invention can deliver equivalent quality to oven fusing without the need for a large oven, a long transverse path or manual handling.

The imaging and press data clearly show that the fusing process employing the dual heating elements allows for rapid fusing speeds without the need for a large oven with a long dwell time. The dual elements also enable the use of contact fusing without the problems of heat/cold offset at the accelerated fusing speeds. The advantages of the compact dual process are accompanied by no loss of press performance or image quality.

The data also show that the dual heating process can be performed using on press developable plates to deliver plate and press quality which are equivalent to or better than standard oven fusing. In addition, the dual fusing process demonstrates the ability to contact fuse coated material at accelerated speeds without the problems of heat/cold offset seen with the conventional fusing process. The process of this invention is superior in both plate visual image quality as well as the quality delivered on press. The improvement in both solid densities delivered on press and in line resolution is not accompanied by a loss of press endurance or performance. This embodiment of the invention delivered high quality images without requiring conventional plate processing or exhibiting the pitfalls of broken lines and non-solid density areas normally observed with electrostatic imaging.

It should be understood that various changes and modifications to the preferred embodiments described herein will be apparent to those skilled in the art. Such changes and modifications can be made without departing from the spirit and scope of this invention and without diminishing its attendant advantages. It is therefore intended that such changes and modifications be covered by the appended claims.

We claim:

1. A method of preparing an imaged element consisting of:

(a) electrostatically imaging at least one surface of an aluminium substrate with a toner composition, (b) pre-heating the imaged substrate using non-contact heating to a first substrate temperature $T_p$;

(c) thereafter heating the imaged substrate a second time to substrate temperature $T_F$, without distortion; and (d) developing the imaged substrate on press with a fount solution.

2. The method of claim 1, in which the aluminum substrate is electrograined and hydrophilized.

3. The method of claim 1, in which a coating composition comprising at least one polymer composition is applied to the surface of the substrate prior to electrostatic imaging of the substrate surface.

4. The method of claim 3, in which the polymer composition is selected from the group consisting of acrylic compositions, phenolic compositions, urethane-urea compositions, phenolic-acrylic compositions, gelatin and mixtures thereof.

5. The method of claim 3, in which the coating composition comprises colloidal silica.

6. The method of claim 3 or 5, in which the polymer composition comprises polyethylene glycol.

7. The method of claim 4, in which the polymer composition is selected from the group consisting of poly (4-vinylphenol), acrylic terpolymers, and polyurethane and mixtures thereof.

8. The method of claim 3, in which the coating composition comprises at least one cross-linking composition.

9. The method of claim 8, in which the cross-linking composition is a titanium complex.

10. The method of claim 3, in which the coating composition comprises at least one acrylic terpolymer.

11. The method of claim 10, in which the acrylic terpolymer has an acid number in the range of about 90–95.

12. The method of claim 10, in which the coating composition comprises at least one acrylic copolymer and a polyurethane resin.

13. The method of claim 3, in which the coating composition is applied to a hydrophilic surface of the substrate.

14. The method of claim 3, in which the coating composition is alkali-soluble.

15. The method of claim 3, in which the substrate surface is first provided with a hydrophilic layer by contacting a surface of the substrate with a liquid comprising a silicate solution in which particulate matter is dispersed, and the alkali soluble composition is thereafter applied to the hydrophilic layer.

16. The method of claim 3, in which the coating composition is gelatin.

17. The method of claim 1, in which radiant heating is used to heat the imaged substrate for the first time to $T_p$.

18. The method of claim 1, in which radiant heating is used to heat the imaged substrate to temperature $T_F$.

19. The method of claim 1, in which a heated roller is contacted with the imaged substrate to heat the imaged substrate to temperature $T_F$.

20. The method of claim 1, wherein $T_F$ is greater than $T_p$.

21. An imaged element prepared by a process consisting of:

(a) electrostatically imaging at least one surface of an aluminium substrate with a toner composition;

(b) pre-heating the imaged substrate using non-contact heating to a first substrate temperature $T_p$;

(c) thereafter heating the imaged substrate a second time to substrate temperature $T_F$, without distortion; and (d) developing the imaged substrate on press with a fount solution.

22. A method of printing comprising:

(a) providing a printing plate prepared by the process consisting of:

(i) electrostatically imaging at least one surface of an aluminium substrate with a toner composition.

(ii) pre-heating the imaged substrate using non-contact heating to a first substrate temperature $T_p$;

(iii) heating the imaged substrate a second time to substrate temperature $T_F$, without distortion; and (iv) developing the imaged subsstrate on press with a fount solution to provide an imaged printing plate.

(b) contacting the imaged printing plate with an ink; and (c) transferring imagewise the ink from the printing plate to a receiving material.

23. The method of claim 1, wherein $T_F$ is equal to or greater than the glass transition temperature of the toner composition.

24. The imaged element of claim 21, wherein $T_F$ is equal to or greater than the glass transition temperature of the toner composition.

25. The method of claim 22, wherein $T_F$ is equal to or greater than the glass transition temperature of the toner composition.

* * * * *